United States Patent [19]

Calamani et al.

[11] Patent Number: 4,489,899

[45] Date of Patent: Dec. 25, 1984

[54] YARN FEEDING APPARATUS FOR MULTI-FEED KNITTING MACHINES

[75] Inventors: Sergio Calamani; Eugenio Turri, both of Milan, Italy

[73] Assignee: Savio & C. S.p.A., Milan, Italy

[21] Appl. No.: 489,346

[22] Filed: Apr. 28, 1983

[30] Foreign Application Priority Data

May 13, 1982 [IT] Italy ..... 21228 A/82

[51] Int. Cl.[3] ..... B65H 51/22

[52] U.S. Cl. ..... 242/47.01; 66/132 T; 226/34

[58] Field of Search ..... 242/47.01, 47.12, 47.13; 66/132 T, 132 R; 226/24, 34

[56] References Cited

U.S. PATENT DOCUMENTS

| | | | |
|---|---|---|---|
| 3,264,845 | 8/1966 | Rosen | 66/132 T |
| 4,153,214 | 5/1979 | Savio et al. | 242/47.01 |

FOREIGN PATENT DOCUMENTS

| | | | |
|---|---|---|---|
| 8101301 | 5/1981 | European Pat. Off. | 66/132 T |
| 1635893 | 5/1973 | Fed. Rep. of Germany | 66/132 T |
| 2102455 | 2/1983 | United Kingdom | 66/132 T |

*Primary Examiner*—Stanley N. Gilreath
*Attorney, Agent, or Firm*—Oblon, Fisher, Spivak, McClelland & Maier

[57] ABSTRACT

The apparatus comprises a support on which a rotatable wheel is mounted an area of the cylindrical surface whereof is in contact with a belt effective to press a yarn thereon which is led through an eye carried on an inlet arm and, respectively, through an eye carried on a yarn outlet arm, such arms being movable between a position whereat they hold the yarn in the nip between the belt and wheel, and a position whereat they hold the yarn out of contact with the belt. The inlet arm is positioned and dimensioned such that, in the condition whereby it holds the yarn inoperative, that is out of contact with the belt, the eye carried thereon is shifted to the opposite side of said belt relatively to a plane led through the longitudinal side edge of the belt lying closer to the eye; whereas, in the operative condition, the inlet arm eye is shifted to the same side of the belt relatively to said plane. Further, the inlet arm eye is located between the belt-to-wheel contact area and a fixed inlet eye which is in substantial alignment with the inlet arm eye, in the condition whereby it is at a position with the yarn inoperative, and the adjacent belt edge.

8 Claims, 8 Drawing Figures

YARN FEEDING APPARATUS FOR MULTI-FEED KNITTING MACHINES

BACKGROUND OF THE INVENTION

This invention relates to a yarn feeding apparatus for multi-feed knitting machines, in particular circular knitting machines.

It is known that with multi-feed knitting machines, i.e. machines whereon a knitted fabric is formed by means of needles arranged to pick up plural feed yarns from a number of cops, reels, or the like, the yarns are picked up from said cops or reels and fed to the needles through feed apparatuses, comprising each a wheel set for free rotation about its own axis and having a substantially cylindrical shaped surface whereon a yarn can be pressed and held by a belt having a smaller height than the wheel driven through a motor means. The belt movement causes the wheel to rotate and entrain the yarn from a respective cop, said yarn being accordingly fed at a preset rate to the respective needles, whereto it is released from the belt and wheel.

In the instance of circular knitting machines, wheels of this type are arranged in a circle at the machine top and the belt which drives them rotatively is a single closed loop configuration.

Feed apparatuses of the wheel type as outlined above are described, for example, in German Pat. Nos. 1 585 298 and 1 635 893.

It is a known fact that it is often necessary to take one or more yarns out of contact with the belt, by shifting the yarn in question along the wheel axis direction, to one side of the cited belt; the yarn is allowed to slip over the surface of the wheel which continues to be rotated by the belt no longer acting, however, on the yarn. This occurs, for example, when the stitch length of the knitting machine is to be changed, or when the type of fabric knitted on the machine is to be changed, or when a knitwork is to be produced which has stripes of different colors and one or more yarns of a given color must be left out of the knitwork being knitted.

Owing to the knitting machines being operated at a high speed, where it becomes necessary to discontinue the feeding of a given yarn, the yarn in question has to be removed very quickly from its position in the nip between the belt and related wheel. Each yarn feeding apparatus is provided with a movable yarn inlet arm which is guided to and from the contact area between the belt and wheel, and with a movable outlet arm on which the yarn leaving the apparatus is passed; this outlet arm is responsive to the tension of the outgoing yarn, thereby lowering the tension on the outgoing yarn results in a decrease of the pressure applied on said arm, which acts mechanically or otherwise on the inlet arm or feeding finger, which moves up and takes the yarn out of the pressure area of the belt onto the wheel. The movable outlet arm which is somewhat longer than the yarn inlet arm, and the yarn trained over the cited wheel is moved and guided through two eyes, made each rigid with each of the arms. The two arms are rigid with each other by the provision of a rotatable shaft carried on the wheel holder; as the yarn is being picked up, both arms are shifted toward the belt so as to retain the yarn under the belt in a substantially longitudinal attitude with respect to the belt. When the feeding of said yarn is to be discontinued, the displacement of the two arms pulls the yarn out of contact with the belt and respective wheel. As mentioned, feed apparatuses of this type are well known and are described, for example, in German Pat. Nos. 1,585,298 and 1,635,893; however, they have the disadvantage of requiring a comparatively long time from the moment when the movable outlet arm acts on the movable inlet arm to shift the yarn laterally with respect to the belt. That time period is governed by the time required, consequently for the displacement and bias force transmitted by the outlet arm, for the inlet arm to move from the inoperative position into the operative one, and viceversa, to move the oncoming yarn to the apparatus from out of contact into the nip under the belt, where it is held pressed against the wheel. In other words, the time involved to take the yarn into the nip between the belt and wheel or move it out of that position, will depend on the effort to be exerted on the yarn by the inlet arm and on the angle wherethrough said arm is to be moved.

With conventional appratuses, the yarn is led to the eye of the inlet arm from a substantially parallel direction to the wheel axis, so that the inlet arm must increase or reduce the amount of yarn picked up therfrom whenever its attitude is to be changed; since the oncoming yarn to the apparatus always tends to apply a pull on the arm with a significant force toward the point where the yarn comes from, it follows that the rotational movement is considerably hindered by the action exerted thereon by the yarn, the arm thus inducing a significant variation in the amount of yarn being fed during the arm moving step. This results in a decrease of the apparatus responsiveness to variations in the pressure exerted by the outgoing yarn on the outlet arm, and hence a relatively low readiness of the apparatus to react to the requirement of changing the yarn feeding conditions or stopping altogether.

Moreover, with conventional apparatuses, the yarn inlet arm is always located in the proximity of the adjacent belt free edge, whereas to cause the apparatus to put the yarn into and out of feed, a shaped member is provided having a sloping surface over which the oncoming yarn to the apparatus is caused to slide, it moving outward, and respectively under, the contact area between the belt and wheel.

This arrangement for moving the yarn out of knitting, or respectively into knitting, namely for feeding it to the opening machine or viceversa, is a time consuming one which does not allow the yarn feeding to the knitting machine to be discontinued or, respectively, initiated at the high rate which would instead be desirable.

SUMMARY OF THE INVENTION

It is a primary object of this invention to provide an improved yarn feeding apparatus, wherein the time required to discontinue the yarn feeding and resume it can be extremely short, and wherein that operation can be controlled by exerting but a minimal effort on the yarn outlet arm for the yarn being fed into the knitting machine.

A further object of the invention is to provide such an apparatus, whose operation is purely mechanical and, hence, of simple construction and low manufacturing cost.

These and other objects are achieved by a yarn feeding apparatus comprising a wheel mounted for idle rotation on a rigid support attachable to a knitting machine and having a plurality of pegs distributed over a cylindrical surface coaxial with said wheel, over an arc of said surface there being trained a belt whose height is lower than the height of said pegs, mounted on said rigid support there being a rotatable shaft extending perpendicularly to the wheel axis and having two oscillating arms keyed thereto, said oscillating arms projecting from two diametrically opposed sides of said wheel and carrying at the free ends thereof an eye or shaped element to let the yarn through, a yarn inlet arm being proximate to the area whereat said belt contacts said wheel, and a yarn outlet arm being proximate to the area whereat said belt separates from said wheel, said arms being arranged to oscillate from an inoperative position wherein the yarn is held out of contact with said belt and the eye of said yarn inlet arm is shifted to the opposite side of said belt with respect to a plane containing the longitudinal side edge of said belt lying closer to said eye and an operative position wherein the yarn is held level with said belt and the yarn inlet arm eye is shifted toward said belt, the apparatus being characterized in that said yarn inlet arm has a length dimension whereby, in said operative position, the yarn inlet arm eye is shifted to the same side of said belt relatively to said plane containing the longitudinal side edge of said belt, and that said rigid support is made integral with a fixed inlet eye wherethrough there is passed the yarn being fed to the eye of said yarn inlet arm which is located between said fixed eye and said belt, said fixed inlet eye being positioned in the proximity of said plane containing the belt longitudinal edge and substantially aligned with the adjacent longitudinal side edge of said belt and with the eye of said yarn inlet arm in the inoperative position thereof.

BRIEF DESCRIPTION OF THE DRAWINGS

To make the construction and features of this feeding apparatus more clearly understood, a preferred embodiment thereof will be presently described by way of example and not of limitation, with reference to the accompanying drawings, where.

DESCRIPTION OF A PREFERRED EMBODIMENT

Figure 1:
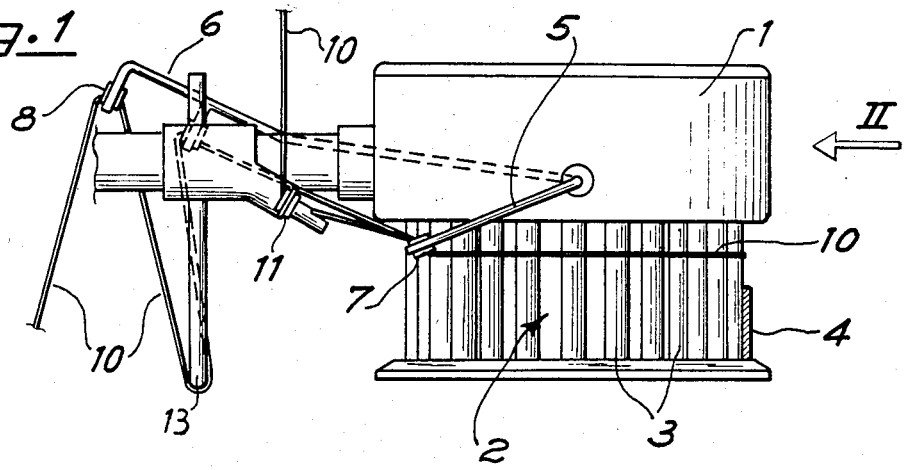
FIGS. 1 and 2 are a side elevation view and front elevation view, respectively, of this apparatus, shown in the condition where it holds the yarn out of knitting, that is out of the contact area between the belt and wheel.

This apparatus, as shown in the drawing figures, comprises a rigid support 1 attachable to the frame of a knitting machine and having, mounted thereon for idle rotation about its axis, a small wheel 2 which has a cylindrical surface bordered by an array of pegs 3, as clearly shown in the drawings. In use, over an arc of the wheel cylindrical surface, there is trained in pressing relationship a belt 4 whose height is smaller than the height of the cited pegs.

Mounted for idle rotation about its axis, lying perpendicularly to the axis of the wheel 2, there is on the support 1 a small shaft 50 whose two ends project from two diametrically opposed sides of the wheel and carry an oscillating inlet arm 5 and oscillating outlet arm 6, respectively, having each, at their free ends, an eye 7, respectively 8, through which the oncoming yarn and, respectively, outgoing yarn to/from the apparatus are passed. As shown in the drawing figures, the inlet arm 5 is located proximate to the area where the belt 4 contacts the wheel 2, the outlet arm 6 being proximate the area where the belt separates from the wheel.

As may be seen in the figures, the inlet arm is dimensioned and positioned such that, in the inoperative condition when the yarn is held out of contact with the belt (FIGS. 1 and 2), the eye 7 is shifted to the opposite side of the belt 4 with respect to a plane containing that belt longitudinal side edge which lies closer to the eye 7.

An essential feature of the present apparatus is that the inlet arm 5 has a length dimension such that, as the inlet arm is shifted into the operative position whereat it feeds the oncoming yarn 10 below the contact area in between the belt and wheel (FIGS. 3 to 5), the eye 7 of the inlet arm is shifted to the same side of the belt with respect to the cited plane conducted through the longitudinal side edge of the belt.

A further essential feature of this apparatus is that, integral with the rigid support 1, is a fixed inlet eye 11 through which is passed the yarn from a yarn supply cop, the yarn being fed into the eye 7 of the inlet arm 5 and the fixed inlet eye 11 being positioned in the proximity of the cited plane containing the longitudinal side edge of the belt. In the embodiment presently described, it would be located on the opposite side of the belt with respect to said plane. Further, the fixed eye 11 is substantially aligned with the belt and with the eye 7 of the inlet arm 5 with the latter in its inoperative position shown in FIG. 1. The yarn from the cop supply, after passing through the fixed inlet eye 11, eye 7 of the inlet arm, and training over a cylindrical portion of the wheel 2, is passed through a fixed outlet eye 12, also made rigid with the support 1 and located above the plane which contains the top free edge of the belt (relatively to FIGS. 1 to 4), to be then passed under a fixed rigid rod 13 (FIGS. 2,4 and 5) and through the eyes 8 of the outlet arm 6.

Figure 2:
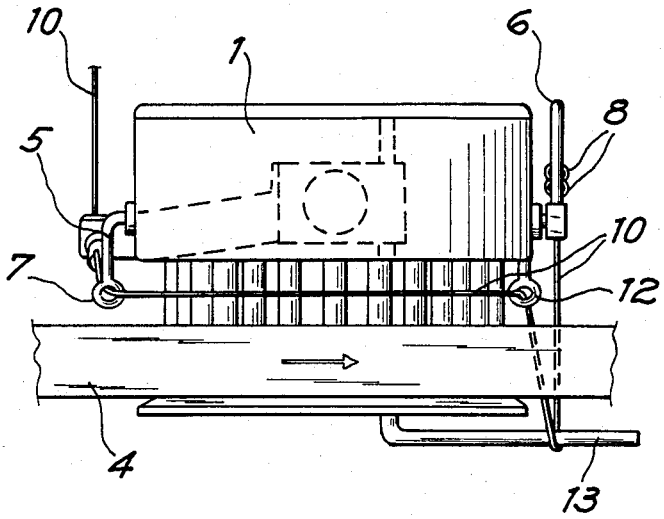

When the yarn 10 is not picked up by the knitting machine, a spring holds the two arms 5 and 6 in the raised position shown in FIGS. 1 and 2. In this condition, the eye 7 of the arm 5 holds the yarn 10 above the belt 4, thereby, even if said belt rotates the wheel 2, the yarn 10 is not picked up from the cop and slides over the surfaces of the pegs 3.

It is now assumed that the yarn 10 is being picked up by the knitting machine: in this condition, the pull exerted on the yarn 10 will cause the outlet arm 6 to be lowered, which results in a counterclockwise rotation of the arm 5 (FIG. 3), thus causing the eye 7 to be lowered on the same side of the belt with respect to the plane conducted through the top edge of the belt.

It may be noted that such lowering of the inlet arm is quite easily effected and responsive, for two essential resons, one of which is that, in the inoperative condition of FIG. 1, the yarn section included between the fixed inlet eye 11 and the area where it contacts the wheel surface, is substantially rectilinear, thereby the downward movement of the eye 7 results in just a small deflection of said yarn section, and involves no drawing of significant amounts of yarn from the cop; the other important reason is that the arm 5 is dimensioned and positioned such that, while performing small oscillations around its own shaft (in common with the arm 6) to move from the yarn non-knitting position (FIG. 1) into the yarn knitting position (FIG. 3), the eye 7 which entrains the yarn 10 is caused to move from a position overlying the plane through the top edge of the belt into a position below the arm itself, that is on the same side of said plane as the belt. The ease and speed at which this transfer of the eye 7 from one side to the other of the cited plane is effected will be facilitated by that, in the operative condition of FIG. 3, the arm 5 forms an angle other than 90°, preferably an angle of about 50°, with a perpendicular plane to the wheel axis. In fact, in going from the inoperative position of FIG. 1 to the operative one of FIG. 3, the vertical (relatively to the figures) component of the eye 7 displacement is a comparatively large one, that is, there occurs a substantial vertical movement of the eye 7 for even small angles of rotation of the arm 5.

Figure 3:
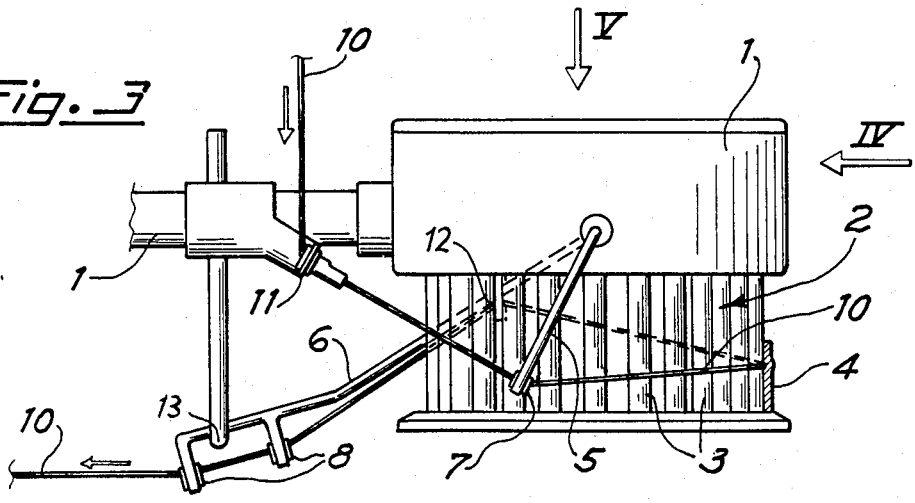
FIGS. 3 and 4 show that same apparatus, again in side elevation and front elevation, but in the condition where it is operative to feed a yarn to the knitting machine.
Figure 4:
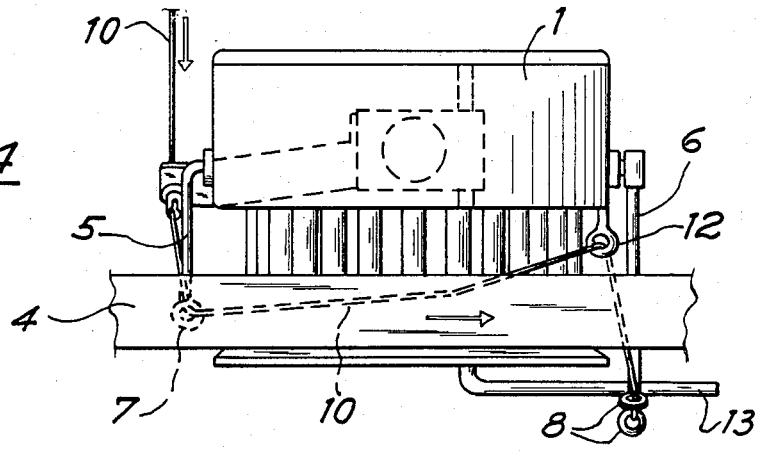
Figure 5:
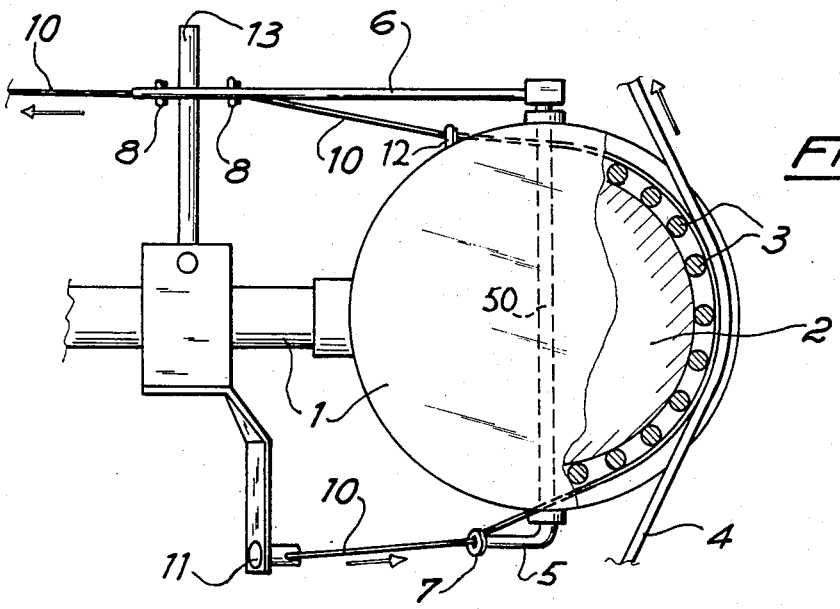
FIG. 5 is a top plan, partly sectional, view of the apparatus, shown in its yarn feeding position of FIGS. 3 and 4.

By contrast, when considering the operative condition of FIGS. 3,4 and 5, if the knitting machines stops picking up the yarn 10, that yarn will cease to exert a downward pull (relatively to the figures) on the outlet arm 6, which owing to the action of a spring provided within the support 1, immediately tends to be raised upwardly into the position shown in FIG. 1, thus causing the inlet arm 5 to rotate in a clockwise direction which, while performing but a small angle of rotational movement, will quickly move the yarn 10 upwards out of the area of contact with the belt 4, thus discontinuing the drawing of that yarn; this movement is facilitated by the yarn section included between the eye 11 and belt, which yarn section will urge the eye 7 upwards.

Figure 8:
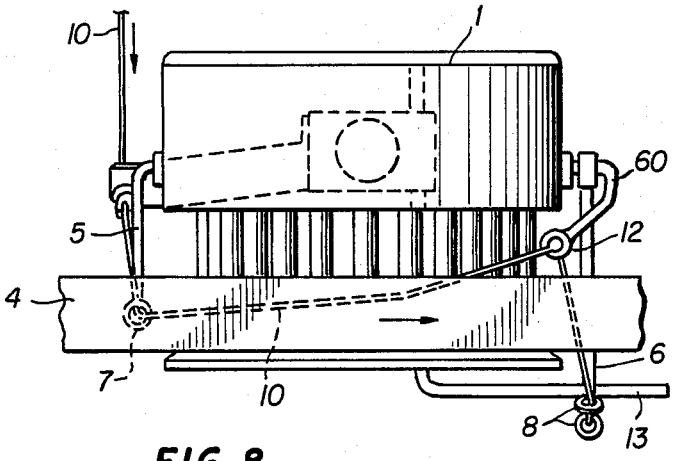
FIG. 8 is a side elevation of a fourth embodiment of the invention.

In FIGS. 1–6, the eye 12 has been shown as fixedly attached to the support 1. In actual practice, it could be carried on an auxiliary moving arm 60, FIG. 8, connected to the outlet arm 6 and such as to shift said moving eye to one side, or respectively to the other side, of the cited plane in the two different operating steps of the apparatus. Of course, the above-cited moving eye could also be made rigid with the outlet arm 6. The operation of placing the apparatus in the inoperative state is facilitated by the provision of the fixed outlet eye 12 which holds the yarn emerging from the contact area with the wheel raised upwardly, that is above the belt 4.

Figure 7:
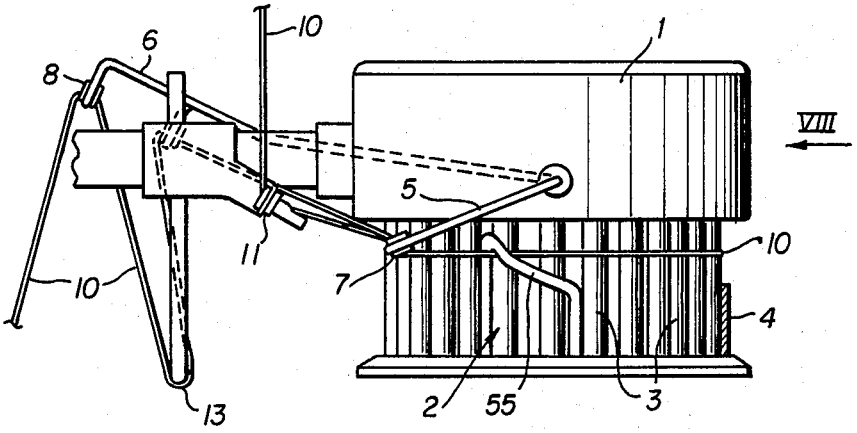
FIG. 7 is a side elevation of a third embodiment of the invention.

If desired, a rigid shaped element 55, FIG. 7, may be made integral with the fixed support which would define a sloping surface toward the belt, intersecting the plane containing the top edge of the belt, that portion of the sloping surface which is closest to the belt being located on the same side of the belt with respect to the cited plane; said element should be placed between the inlet arm 5 and the belt, and is well known in the art, and disclosed, for example, in German Pat. Nos. 1 585 298 and 1 635 893.

Figure 6:
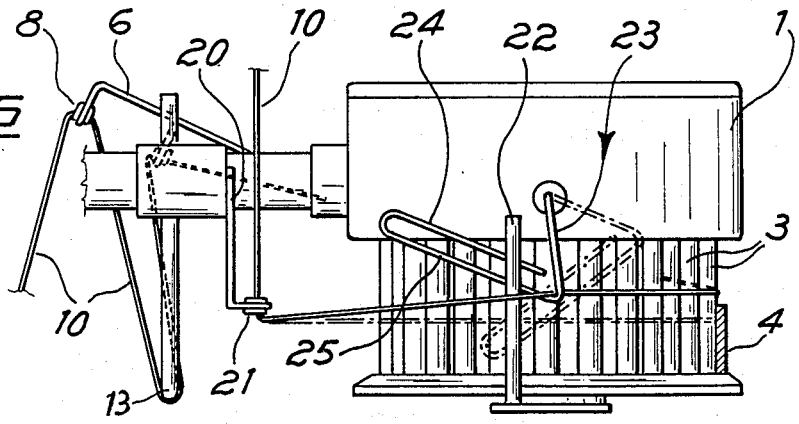
FIG. 6 is a side elevational view of a second embodiment of the invention.

Shown in FIG. 6 is a modified embodiment of the apparatus described above, in that figure all those parts which have similar constructions and functions to those shown in FIGS. 1 to 5 being designated for simplicity with the same reference numerals.

In the apparatus of FIG. 6, there is provided a fixed bracket 20 which supports an inlet eye 21 which, as shown in the drawing, is arranged on the same side of the belt with respect to a plane conducted through the top longitudinal edge of the belt. It may be noted that the apparatus rigid support carries an elongate peg 22 which is located laterally to the wheel and extends parallel to the wheel axis and to the pegs 3.

The yarn inlet arm, generally indicated at 23, has a portion 24 thereof shaped as a somewhat elongate slot and extending between the peg 22 and wheel. In FIG. 6, the yarn inlet arm has been shown in full lines in the inoperative position thereof, and in dash lines in the operative position, i.e. the position whereat the yarn (also shown by a dashed line in this condition) is caught between the belt and wheel and entrained by the latter. It may be seen that the yarn, as the arm is moved from the operative position into the inoperative one (and viceversa), slides along the elongate slot of the arm, which causes it to be shifted along the peg 22 on which the yarn being picked up by the apparatus moves. This embodiment of the invention is no further described because its construction and mode of operation will be apparent from the foregoing discussion.

The present apparatus has a purely mechanical character, a very simple and reliable operation mode, and is inexpensive to make, while ensuring in all cases a very high speed of transfer of the yarn from the knitting position to the non-knitting position, and viceversa, by virtue of the size and positioning of the inlet arm 5 and of the provision and positioning of the fixed inlet eye 11, which features have been duly discussed in the foregoing.

It will be appreciated that the belt 4, instead of being arranged to rest on the lower portion of the wheel, with reference to FIGS. 1 to 4, may be arranged to bear on the upper portion of the wheel, in which case the arm 5 will form, with respect to the arm 6, a larger angle than 90°, whereas in the instance illustrated in the drawings that angle is smaller than 45°, said angles being computed on the basis of the diagrams provided in FIGS. 1 and 3; in that case, the length of the arm should be adequate to permit the eye carried thereon to locate itself below a plane conducted through the belt free longitudinal bottom edge with the yarn in the non-knitting position.

What is claimed as new and desired to be secured by Letters Patent of the United States is:

1. A yarn feeding apparatus for multi-feed knitting machines, said apparatus comprising:

a wheel mounted for idle rotation about an axis on a rigid support attachable to a knitting machine and having a plurality of pegs distributed over a cylindrical surface thereof coaxial with said wheel;

a belt trained over an arc of said cylindrical surface, said belt having a height lower than the height of said pegs;

a rotatable shaft mounted on said rigid support and extending perpendicularly to said wheel axis and having two oscillating arms keyed thereto, said oscillating arms projecting from two diametrically opposed sides of said wheel and each carrying at the free end thereof an eye element to let the yarn through, said oscillating arms defining a yarn inlet arm positioned proximate to an area whereat said belt contacts said wheel, and a yarn outlet arm positioned proximate to an area whereat said belt separates from said wheel, said inlet and outlet arms being arranged to oscillate from an inoperative position wherein the yarn is held out of contact with said belt and said eye of said yarn inlet arm is shifted to a side of a plane containing the longitudinal side edge of said belt which is opposite said belt, and an operative position wherein the yarn is held level with said belt and the yarn inlet arm is shifted toward said belt, wherein said yarn inlet arm has a length dimension such that, in said operative position, the yarn inlet arm eye is shifted to the same side of said belt relatively to said plane containing the longitudinal side edge of said belt, and a fixed inlet eye wherethrough there is passed the yarn being fed to said eye of said yarn inlet arm which is located between said fixed eye and said belt, said fixed inlet eye being positioned in the proximity of said plane containing the belt longitudinal edge and being substantially aligned with said eye of said yarn inlet arm in the inoperative position thereof.

2. An apparatus according to claim 1, wherein said fixed inlet eye is located on a side opposite said belt with respect to said plane conducted through said longitudinal edge of said belt.

3. An apparatus according to claim 1, wherein said fixed inlet eye is located on the same side as the belt with respect to said plane conducted through said longitudinal edge of said belt, wherein said rigid support carries an elongate peg located laterally to said wheel and extending substantially parallel to the wheel axis, and wherein said eye carried on said yarn inlet arm has an elongate shape and extends between said peg and said wheel, the axis of said elongate eye forming an acute angle with planes perpendicular to the wheel axis, both in the operative and inoperative positions thereof.

4. An apparatus according to claim 1, wherein a plane containing said inlet arm and the shaft rigid therewith forms, with a plane containing said shaft and the outlet arm, an angle such that said inlet arm, in said operative position thereof, forms an angle other than 90° with a plane perpendicular to said wheel axis.

5. An apparatus according to claim 4, wherein said angle is about 50°.

6. An apparatus according to claim 1, including a fixed outlet eye located between said belt and said outlet arm and over which the yarn trained over said wheel is passed, said fixed outlet eye being positioned on a side opposite said belt with respect to said plane conducted through said belt longitudinal side edge.

7. An apparatus according to claim 1, wherein a movable outlet eye is provided between said belt and outlet arm, over which the yarn is passed which comes out of said wheel prior to being fed into the eye of said outlet movable arm, said movable eye being movable to two sides of said plane.

8. An apparatus according to claim 1, inclduing a rigid element positioned between said inlet arm and said belt, said rigid element being adapted to define a sloping surface intersecting said plane conducted through said longitudinal side edge of said belt, the sloping surface portion lying closest to said belt being located on the same side of said plane as said belt.

* * * * *